United States Patent [19]

Gray

[11] Patent Number: 4,844,440

[45] Date of Patent: Jul. 4, 1989

[54] SHEET REGISTRATION APPARATUS

[75] Inventor: John R. Gray, Welwyn Garden City, England

[73] Assignee: Xerox Corporation, Stamford, Conn.

[21] Appl. No.: 207,343

[22] Filed: Jun. 15, 1988

[30] Foreign Application Priority Data

Jun. 26, 1987 [GB] United Kingdom ..... 8715014

[51] Int. Cl.[4] ..... B65H 9/00

[52] U.S. Cl. ..... 271/226; 271/236; 271/221; 271/271

[58] Field of Search ..... 271/226, 233, 234, 236, 271/248, 250, 253, 254, 221, 222, 225, 243, 244, 246, 245, 251, 269, 271; 221/260

[56] References Cited

U.S. PATENT DOCUMENTS

| | | | |
|---|---|---|---|
| 3,291,480 | 12/1966 | Haddad | 271/42 X |
| 3,970,299 | 7/1976 | Berger, Jr. et al. | 271/233 X |
| 4,073,391 | 2/1978 | O'Brien et al. | 214/65 |
| 4,147,342 | 4/1979 | Naramore | 271/221 |
| 4,295,645 | 10/1981 | Nahar et al. | 271/34 |
| 4,319,743 | 3/1982 | Rood | 271/236 X |
| 4,475,733 | 10/1984 | Benson | 221/260 X |
| 4,641,949 | 2/1987 | Wallace et al. | 355/3 |
| 4,648,589 | 3/1987 | Emrich et al. | 271/250 X |

FOREIGN PATENT DOCUMENTS

| | | | |
|---|---|---|---|
| 0177251 | 10/1984 | Japan | 271/221 |
| 414690 | 6/1966 | Switzerland | 271/222 |
| 11722 | of 1914 | United Kingdom | 271/89 |
| 542628 | 1/1942 | United Kingdom | 271/89 |

OTHER PUBLICATIONS

Xerox Disclosure Journa, vol. 6, No. 5, pp. 267, 268, Sep./Oct. 1981

*Primary Examiner*—Joseph J. Rolla
*Assistant Examiner*—Stephen B. Parker
*Attorney, Agent, or Firm*—William A. Henry, II

[57] ABSTRACT

Apparatus for registering one or more sheets in a registration position defined for example in a corner formed by two edge stops has a sheet support member and a tamping member that engage the edge or edges of the sheet or sheets on the support member. The tamping member is mounted on the end of an arm which is mounted for angular movement about a shaft. On movement of the arm the tamper moves so as to push the sheet(s) into the registration position. The tamping member includes a brush having bristles that engage the edge(s) of the sheet(s).

4 Claims, 1 Drawing Sheet

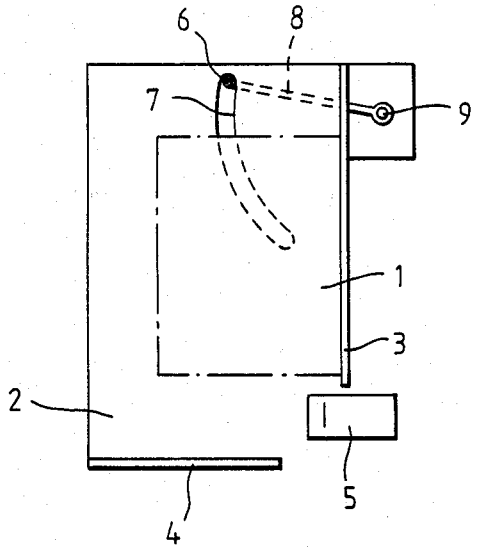
Fig.1.
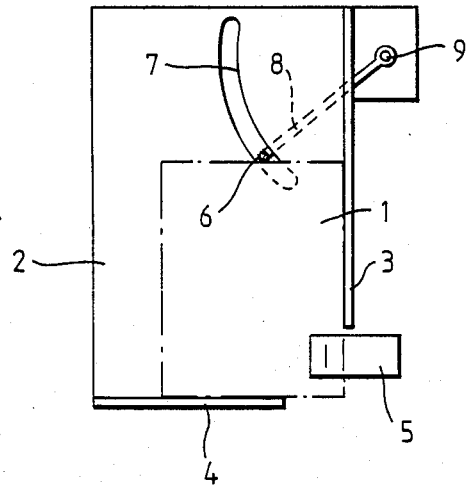
Fig.2.
Fig.3.
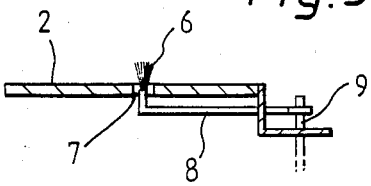

SHEET REGISTRATION APPARATUS

This invention relates to an apparatus for registering one or more sheets in a registration position. The invention is particularly, although not exclusively, useful in an apparatus, such as the finisher of a xerographic copying machine, in which a stack of sheets needs to be accurately registered, and tamped into a neat stack, before delivery to an output tray, or before the insertion of a staple by a stapling mechanism.

In prior systems, for example, U.S. Pat. No. 4,073,391 a sheet jogger is shown for aligning sheets for a stapling operation prior to discharge. A back jogger, side guides, and a roller in the base of a tray cooperate to align and justify sheets, and are all controlled by a single control means. Each discharged bundle can be offset from the previous bundle. In U.S. Pat. No. 4,147,342 an apparatus for aligning a stack of sheets against a stop member is disclosed. Sheet registration is achieved by a vertically extending tamper which pushes against a stack of sheets while vibrating at high frequency. A device for directing documents toward a front wall of a hopper is disclosed in U.S. Pat. No. 4,295,645. A series of rollers protruding through slots in the base of a hopper engage the edges of the documents. A spring-biased flag applies force to the side of the documents to direct them toward the feeder rolls.

One of the simplest ways of registering a stack of sheets is to push the stack towards its registration position, which may be defined either by a single edge stop or by two edge stops which constitute a corner. If a rigid pusher or tamper is used, there is the disadvantage that damage may occur to the sheets. A tamper having a surface which is soft enough not to damage the sheets will typically be liable to be damaged by the edges of the sheets.

It is an object of the present invention to provide an apparatus for registering sheets in which these disadvantages are overcome.

According to the present invention, there is provided an apparatus for registering one or more sheets in a registration position comprising a sheet support member, a tamping member adapted to engage the edge or edges of the sheet or sheets on the support member, and means to cause the tamping member to move so as to push the sheet(s) into the registration position, the tamping member comprising a brush the bristles of which engage the edge(s) of the sheet(s).

The apparatus of the invention has the advantage that the brush is rigid enough to move paper sheets without damaging them, is sufficiently compliant to accommodate paper size tolerances, and shows very little wear.

An apparatus in accordance with the invention will now be described, by way of example, with reference to the accompanying drawings, in which:

FIG. 1 is a diagrammatic plan view of part of a finisher of, for example, a xerographic copying machine, incorporating the apparatus of the present invention, with a paper sheet delivered thereto, but in an unregistered position;

FIG. 2 is a similar view of FIG. 1, shown after operation of the registration apparatus of the invention, with a paper sheet in the registered position; and FIG. 3 is an elevational view of part of the apparatus of FIG. 1, showing the brush tamping member of the invention.

Referring to the drawings, a paper sheet 1 is delivered to a sheet support member such as a tray 2, from the output of a machine such as a xerographic copying machine (not shown). The paper sheet 1 may be delivered either from the left or the right of the drawing as seen in FIGS. 1 and 2, or from above, for registration in the corner defined by the two edge stops 3 and 4 which are right angles to one another. The tray 2 may slope downwards towards the right-hand side of the Figures, i.e. towards edge stop 3, so that sheets delivered into the tray will tend to come to rest in the position shown in FIG. 1.

In the corner defined by edge stops 3 and 4, i.e. the lower right-hand corner of the tray 2, as viewed in FIGS. 1 and 2, a stapling mechanism 5 is positioned so that its jaws straddle the corners of a stack of sheets delivered onto the tray 2 and positioned as shown in FIG. 2, in the registration position.

In order to move a stack of sheets to the registration position (FIG. 2) from the delivery position (FIG. 1) a tamper 6 is used. Tamper 6 projects upwardly through a curved slot 7 in the tray 2, and is mounted at the end of an arm 8 which is pivotally mounted at its other end on a motor driven shaft 9. On actuation of the motor, arm 8 is rotated anticlockwise, causing tamper 6 to move to the position shown in FIG. 2, thereby pushing the sheets into the registration corner. Alternatively, the other end of arm 8 may be mounted on a cam follower which is spring-urged into engagement with a camming surface. The camming surface is so shaped that on rotation it moves the cam, and hence the tamper 6 at suitable speeds. Thus, for example, the tamper may be moving relatively slowly as it engages a sheet edge and as the sheet approaches the registered position.

The tamper 6 consists of a brush, only the bristles of which protrude through the slot 7 in the tray 2. The resilience of the bristles accommodates varistions in sheet size, and prevents damage to the sheet edges. It is found that the brush bristles show very little wear.

In a preferred mode of operation of the apparatus, the tamper is activated once for each sheet delivered into the tray 2, so that an accurately tamped and registered sheet stack is formed. Alternatively, for small stacks, all the sheets in a stack may be first delivered, and then the whole stack tamped. Furthermore, the apparatus is suitable for the registration of single sheets.

Although an arcuate motion of the tamper 6 has been described, it might equally make a linear motion, either at right angles to a registration edge, or inclined to it at some other angle.

What is claimed is:

1. Apparatus for registering at least one sheet in a registration position comprising a sheet support member, a tamping member adapted to engage at least one edge of said at least one sheet on the support member and means to cause the tamping member to reciprocate so as to push said at least one shut into the registration position, the tamping member comprising a brush the side edges of the bristles of which engage said at least one edge of said at least one sheet.

2. The apparatus of claim 1 wherein the tamping member is mounted at one end of an arm which is arranged to make angular movements about its other end.

3. The apparatus of claim 1 wherein said sheet support member is a tray member, and wherein the brush bristles protrude through a slot in said tray member.

4. The apparatus of claim 3 wherein said slot is an arcuate slot having a radius appropriate to the length of said arm.

* * * * *